US008188934B2

(12) United States Patent
Haapala et al.

(10) Patent No.: US 8,188,934 B2
(45) Date of Patent: May 29, 2012

(54) ANTENNA STRUCTURE AND A METHOD FOR ITS MANUFACTURE

(75) Inventors: Tomi Haapala, Kempele (FI); Mika Pekkala, Oulunsalo (FI); Janne Penttila, Pattijoki (FI)

(73) Assignee: Powerwave Comtek OY, Kempele (FI)

( * ) Notice: Subject to any disclaimer, the term of this patent is extended or adjusted under 35 U.S.C. 154(b) by 222 days.

(21) Appl. No.: 12/194,745

(22) Filed: Aug. 20, 2008

(65) Prior Publication Data

US 2009/0015502 A1 Jan. 15, 2009

Related U.S. Application Data

(63) Continuation of application No. PCT/FI2006/000189, filed on Jun. 12, 2006.

(30) Foreign Application Priority Data

Mar. 2, 2006 (FI) ..... 20060211

(51) Int. Cl.
*H01Q 9/26* (2006.01)

(52) U.S. Cl. ..... 343/803; 343/789

(58) Field of Classification Search ..... 343/700 MS, 343/700 R, 702, 705, 713, 718, 725, 726, 343/727, 729, 741, 742, 745, 749, 753, 754, 343/756, 761, 767, 770, 772, 776, 789, 790, 343/792, 792.5, 793, 795, 797, 802, 803, 343/807, 812, 813, 814, 815, 816, 817, 818, 343/819, 820, 821, 824, 822, 828, 829, 830, 343/833, 844, 845, 846, 848, 850, 853, 859, 343/860, 866, 874, 878, 886, 890; 343/840, 343/841, 891, 893, 895, 909, 912, 804
See application file for complete search history.

(56) References Cited

U.S. PATENT DOCUMENTS

| | | | |
|---|---|---|---|
| 4,495,505 | A | 1/1985 | Shields |
| 5,280,297 | A | 1/1994 | Profera, Jr. |
| 5,293,176 | A | 3/1994 | Elliot |
| 5,796,372 | A | 8/1998 | Elliot |
| 5,999,141 | A | 12/1999 | Weldon |
| 6,313,809 | B1 | 11/2001 | Gabriel et al. |
| 2002/0163476 | A1 | 11/2002 | Eriksson |

(Continued)

FOREIGN PATENT DOCUMENTS

| | | |
|---|---|---|
| EP | 0685900 | 12/1995 |

(Continued)

OTHER PUBLICATIONS

Kraus, J.D., Antennas. Singapore 1988, McGraw-Hill, p. 743.

(Continued)

*Primary Examiner* — Jacob Y Choi
*Assistant Examiner* — Kyana R McCain
(74) *Attorney, Agent, or Firm* — OC Patent Law Group

(57) ABSTRACT

The antenna has an antenna element and a feed tower for forming a feed to the antenna element. In addition, the antenna has a dielectric support plate, which is mechanically fastened to the first end of the feed tower. The antenna element is in the form of a folded dipole, and it consists of metal strips connected with each other on at least two surfaces of the dielectric support plate. At the first end, the feed tower is electrically connected to two different points of the antenna element.

13 Claims, 7 Drawing Sheets

U.S. PATENT DOCUMENTS

| | | | | |
|---|---|---|---|---|
| 2004/0080465 | A1* | 4/2004 | Hendler et al. | 343/795 |
| 2004/0119551 | A1* | 6/2004 | Wray | 333/22 R |
| 2004/0155831 | A1* | 8/2004 | Goebel et al. | 343/775 |
| 2004/0222937 | A1 | 11/2004 | Gottl et al. | |
| 2006/0038723 | A1* | 2/2006 | Watanabe et al. | 343/700 MS |
| 2006/0097948 | A1 | 5/2006 | Qi et al. | |

FOREIGN PATENT DOCUMENTS

| | | |
|---|---|---|
| GB | 2333400 | 7/1999 |
| GB | 2424765 | 10/2006 |
| JP | 2004289371 | 10/2004 |
| WO | 89/10012 | 10/1989 |
| WO | 03/098168 | 11/2003 |

OTHER PUBLICATIONS

J.S. McLean, Balancing Networks for Symmetrical Antennas 1: Classification and Fundamental Operation, IEEE Transactions on Electromagnetic Compatibility, vol. 44, No. 4, Nov. 2002.

International Search Report and Written Opinion pertaining to International Application No. PCT/FI2006/000189 dated Nov. 28, 2006.

Finnish Search Report pertaining to Application No. 20060211 dated Jan. 23, 2007.

* cited by examiner

ANTENNA STRUCTURE AND A METHOD FOR ITS MANUFACTURE

The invention relates generally to antenna structures in radio devices. In particular, the invention relates to the manufacture of an antenna structure so that the antenna has a broad bandwidth and that it is easily adjustable to the desired feed impedance.

BACKGROUND OF THE INVENTION

Requirements are often set to the antenna structures of small radio devices that often cause mutual conflicts. The antenna should be small and efficient (the efficiency of an antenna upon transmission is determined as the relation of the radiated power to the power supplied to the antenna). It should have a broad bandwidth, which covers well the whole frequency range to be used and, in addition, the antenna should be easily adjustable to the impedance of the antenna gate of the radio device. Further, the antenna should be of a solid structure, and its manufacture should be easy. A very big part of time used in the manufacture of a single antenna in serial production goes to the heating and cooling phases required by the solders so that as small a need for solders as possible would be preferable from the manufacturing-technical point of view.

An antenna type, which has very advantageous bandwidth characteristics in spite of its small size, is a folded dipole. Some recent variations in the folded dipole principle are known, for example, from the reference publications U.S. Pat. No. 5,293,176 and U.S. Pat. No. 5,796,372. However, a disadvantage of a folded dipole is that its natural feed impedance sets approximately near to 300 ohm, while most radio devices are designed taking into consideration antenna impedances of 50 ohm or 75 ohm. Connecting a folded dipole as the antenna of such a radio device requires the use of a balun or some other interface circuit, which causes additional costs in the manufacture and generally narrows the available bandwidth.

One small antenna type is also known from the reference publication US 2004/0222937 A1. An especially broad bandwidth is given as its advantage. However, the radiating part of the antenna is complex, and its several branches have not been supported very well mechanically.

SUMMARY OF THE INVENTION

An objective of the present invention is to present a small-sized antenna structure, which has a broad bandwidth and which is easily adjustable to the desired feed impedance. It is also an objective of the invention to present a method for the manufacture of such an antenna structure, which is fast and advantageous from the manufacturing-technical point of view. In addition, it is an objective of the invention to present an antenna structure and its manufacturing method, which provide the antenna with good efficiency in a wide frequency range.

The objectives of the invention are achieved by forming an antenna radiator of the folded dipole type onto the surfaces of a planar support structure and by attaching the part so obtained to a feed tower, a branch of which works as a transmission line.

An antenna according to the invention has an antenna element and a feed tower for establishing a feed to the antenna element. It is characteristic of the antenna that

- the antenna has a dielectric support plate, which is mechanically attached to the first end of the feed tower,

- the antenna element is in the form of a folded dipole, and it consists of metal strips connected to each other on at least two surfaces of the dielectric support plate, and
- in said first end, the feed tower is electrically connected to two different points in the antenna element.

The invention also relates to a method for manufacturing an antenna structure, the method being characterised in that an antenna element in the form of a folded dipole is formed from metal strips connected to each other on at least two surfaces of a dielectric support plate, and the dielectric support plate is mechanically attached to the first end of the feed tower so that in said first end the feed tower is electrically connected to two different points in the first antenna element.

The antenna structure of the invention has at least one antenna radiator of the type of a folded dipole, consisting of conductive areas on the surface of the dielectric support plate, and possibly of vias connecting these. In addition, the structure has a feed tower, which is most preferably attached to the dielectric support plate without a solder, for example, by screws or other mechanical fastening elements. The principal direction of the feed tower, i.e. the direction of the longitudinal axis, is essentially perpendicular to the dielectric support plate. For facilitating the verbal description, the end of the feed tower, to which the dielectric plate is attached, can be called the upper end. The opposite end is the lower end, respectively.

The feed tower has electrically conductive branches extending in the direction of its longitudinal axis and from the lower end towards the upper end. Two feed points of the folded dipole are located in the upper end of the two branches of the feed tower. The upper end of the first branch consitutes one feed point. A feed conductor, a certain section of which constitutes a transmission line together with the first branch, folds towards the upper end of the second branch in the upper section of the feed tower, forming there a second feed point.

An antenna structure may have several radiating antenna elements. In one preferred embodiment there are two folded dipoles placed crosswise to the dielectric support plate. In this case, the feed tower has four branches, respectively; two for each folded dipole. It is possible to make use of two crossed folded dipoles for achieving orthogonal polarisations.

BRIEF DESCRIPTION OF THE DRAWINGS

The invention will next be explained in more detail, referring to the preferred embodiments shown as an example and to the enclosed drawings, in which.

DETAILED DESCRIPTION OF THE INVENTION

Same reference numbers are used for corresponding parts in the Figures. The exemplary embodiments of the invention, which will be explained in this patent application, do not restrict the coverage of the patent claims disclosed later. The features disclosed in the dependent claims may be freely combined with each other, unless literally mentioned otherwise in this specification. The verb "to comprise" and its derivatives have been used as open epithets in this specification, and they do not exclude the possibility that the described object would have other features than those that are literally mentioned in the specification.

Figure 1:
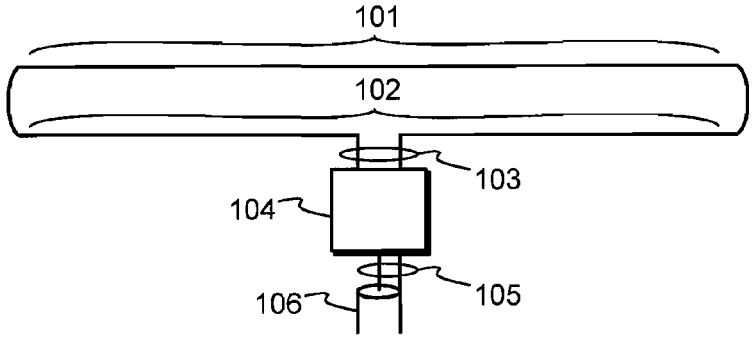
Fig. 1 PRIOR ART
FIG. 1 illustrates a known principle of a folded dipole antenna.

FIG. 1 illustrates a principle of a folded dipole known in itself. A radiating antenna element consists of an upper conductor 101 and a lower conductor 102, which are connected to each other at their ends. The lower conductor 102 is cut off in the middle so that it forms a balanced feed 103 consisting of two feed points. Alternatives include connecting this balanced feed to the balanced antenna gate (not shown in the Figure) of the radio apparatus through a balanced transmission line, or the use of an impedance transformer 104 according to FIG. 1, by means of which the balanced feed 103 of the folded dipole is converted into an unbalanced 105 feed, which is connected to an unbalanced transmission line (e.g. a coaxial cable) 106.

Figure 2:
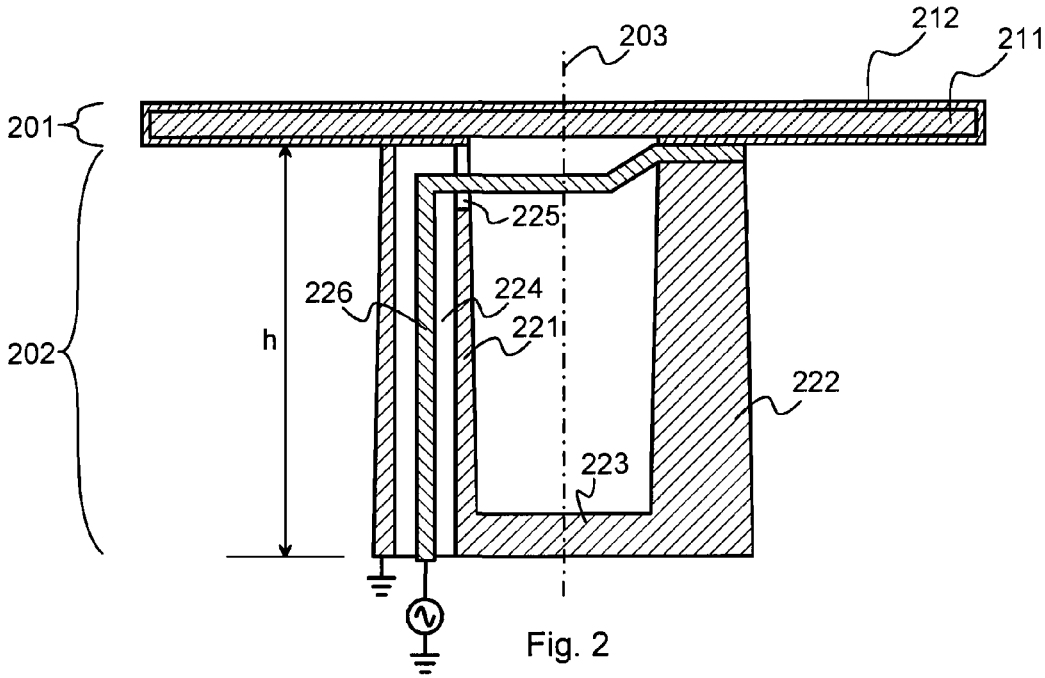
FIG. 2 illustrates an antenna structure according to one embodiment of the invention.

FIG. 2 is a cross section of a simple embodiment of the invention. The two main parts of the antenna structure are the antenna plate 201 and the feed tower 202. The antenna plate 201 has a dielectric support plate 211 and an antenna radiator 212 formed onto its surface of conductive areas. In the embodiment of FIG. 2, the antenna radiator is a strip-type conductive area, continuing straight over the one surface (the surface pointing upwards in the Figure) of the dielectric plate 211 and turning around the edges of the dielectric support plate 211 at both ends to its other surface (lower surface). In this specification, the words indicating direction, such as "up" and "down" refer only to the enclosed Figures and they do not restrict the manufacture or use of the antenna structure of the invention in any certain position.

The feed tower 202 has a first branch 221 and a second branch 222 extending in the direction of its longitudinal axis 203, and a bottom 223 connecting the lower ends of the branches. The first branch 221 is hollow, i.e. a longitudinal cavity 224 exists inside it through the entire first branch 221 from up to down. The wall of the upper end of the first branch 221 has a notch 225 on the side facing towards the second branch 222. The feed conductor 226 is a longitudinal conductor, travelling in the cavity 224 in the first branch 221, turning out from the notch 225 in the upper part of the first branch 221, and extending from there to the upper end of the second branch 222, where the end of the feed conductor 226 remains between the upper end of the second branch 222 and the right end of the antenna radiator 212. The upper end 221 of the first branch contacts the left end of the antenna radiator 212. The antenna structure is intended to be connected to an antenna gate (not shown in the Figure) of a radio device by an unbalanced transmission line, the signal conductor (e.g. the middle conductor of a coaxial cable) of which is connected to the lower end of the feed conductor 226 and the earth conductor (the shell of a coaxial cable) is connected to the root of the feed tower at the lower end of the first branch 221.

Figure 3:
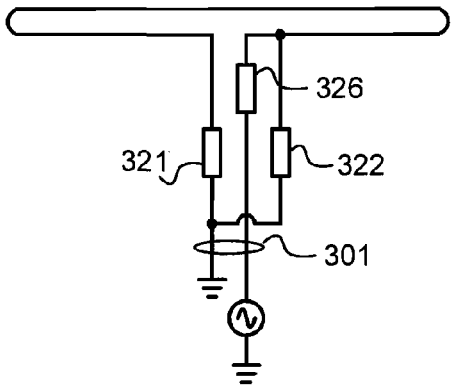
FIG. 3 illustrates the electrical function of the antenna structure in FIG. 2.

FIG. 3 is a simple electrical model of the function of the antenna structure shown in FIG. 2. In FIG. 3, the point 301 corresponds to the feed of the antenna structure in FIG. 2, i.e. the point, in which the lower end of the feed conductor 226 comes out from the lower end of hollow first branch 221. The impedance 321 represents the impedance formed by the first branch 221 between said feed and the point, in which the upper end of the first branch 221 contacts the left end of the antenna radiator 212. The impedance 326 represents the impedance of the feed conductor 226 between the feed and the point, in which the upper end 226 of the feed conductor contacts the right end of the antenna radiator 212. The impedance 322 represents the impedance, which is formed between the feed and the point, in which the upper end of the second branch 222 of the feed tower contacts—through the upper end of the feed conductor remaining between—the right end of the antenna radiator 212. The impedance 322 includes the effects of both the second branch 222 and the bottom 223 of the feed tower.

When the dimensioning of the feed tower is suitable, the impedances 321, 322 and 326 together form an adjusting element, which adjusts the feed impedance of approximately 300 ohm characteristic of a folded dipole to a considerably lower value, which is between 35-120 ohm; for example, 100, 85, 75, or 50 ohm. The feed of the antenna structure (i.e. the point, in which the lower end of the feed conductor 226 comes out from the lower end of the hollow first branch 221) can be connected to the antenna gate of a conventional radio device by an unbalanced transmission line. Because a radio signal with the frequency of hundreds of megahertzes or some gigahertzes travels only along the surface even in a thoroughly conductive piece, mainly the conductivity of the surface material of the feed tower 202 and the height of the feed tower, which is indicated by the letter h in FIG. 2, are significant for the impedances 321 and 322. The height h of the feed tower should essentially be approximately of the size of a quarter of a wavelength with the radio frequency used. The material for the feed tower can be, for example, uniform metal, metal coated with another metal, or plastic coated with metal. The invention does not restrict the selection of the material for the feed tower or the surface treatment, as long as the conductivity of its surface can be made suitable.

Figure 4:
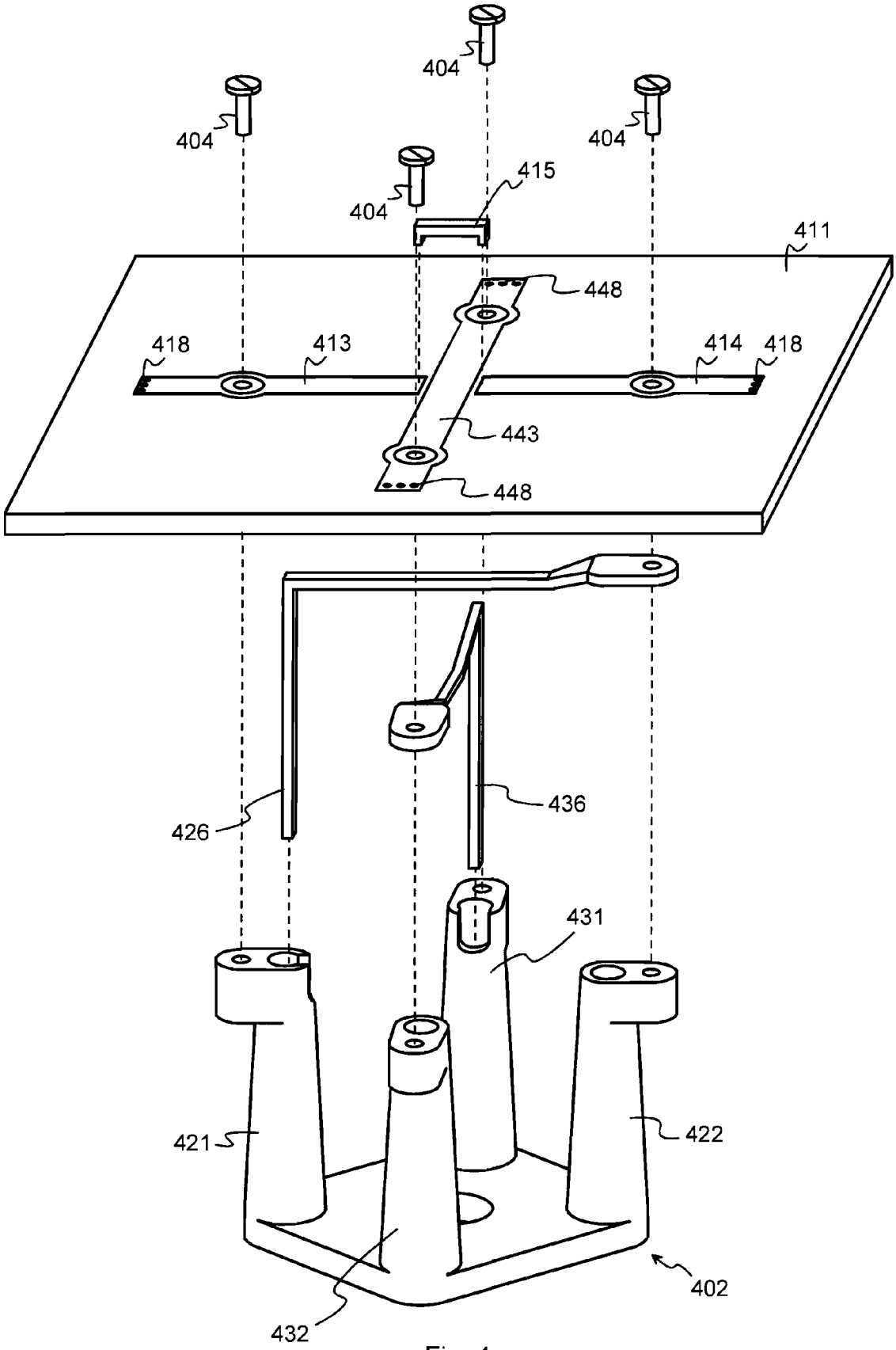
FIG. 4 illustrates an antenna structure according to an embodiment of the invention.
Figure 5:
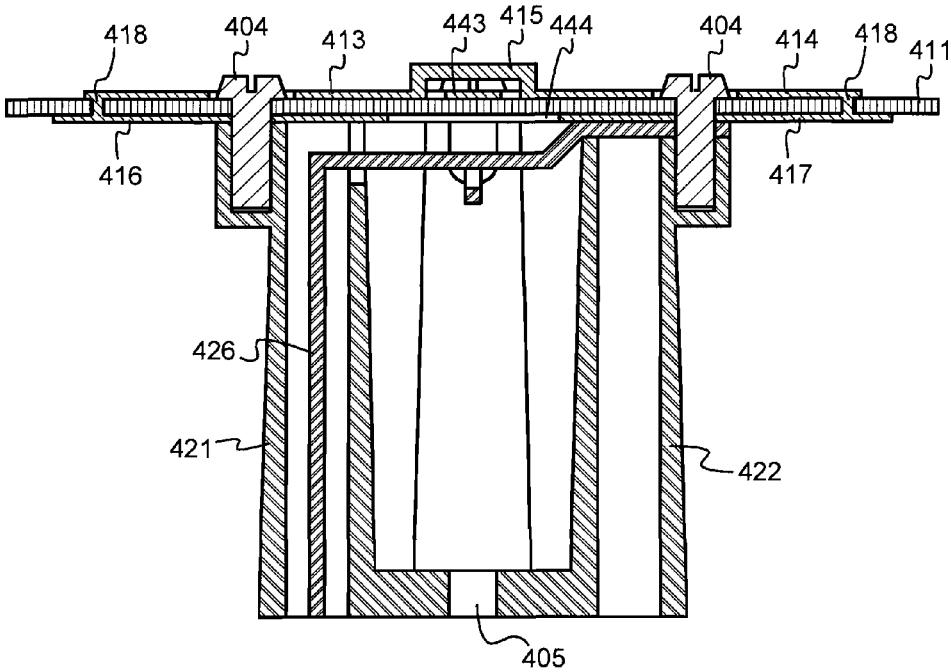
FIG. 5 illustrates the same antenna structure as in FIG. 4.

FIG. 4 is an exploded view of the antenna structure according to an embodiment of the invention. The cross section of the same antenna is illustrated in FIG. 5. This antenna structure has two crossed antenna radiators in the form of a folded dipole, and an own feed conductor for each. The feed tower 402 has four essentially parallel branches, of which the branches 422 and 432 are shorter than the branches 421 and 431 by the thickness of the flat upper end of the feed conductor. The feed conductors 426 and 436 are placed into vertical cavities travelling through the branches 421 and 431, respectively, so that the horizontal section at the upper end of both feed conductors protrudes from the notch in the upper part of the branch in question. Said essentially horizontal section in the second feed conductor (here the feed conductor 436) is slightly bent downwards from the middle so that the feed conductors can cross without contacting each other.

The dielectric support plate 411 is attached to the upper end of the feed tower 402 with screws. The first antenna radiator in the form of a folded dipole consists of metal strips 413 and 414 on the upper surface of the dielectric support plate 411, a bridge section 415 connecting these, metal strips 416 and 417 on the lower surface of the dielectric support plate 411, and metallised vias 418, which connect the outer ends of the metal strips on the upper and lower surface of the dielectric support plate 411 with each other. The second antenna radiator, placed crosswise in relation to the first one, consists of a metal strip 443 on the upper surface of the dielectric support plate 411, metal strips on the lower surface of the dielectric support plate 411, of which only one metal strip 444 is shown in FIG. 5 due to the selected graphical manner of representation, and metallised vias 448, which connect the outer ends of the metal strips on the upper and lower surface of the dielectric support plate 411 with each other. The antenna radiators in the form of a folded dipole are identical with the exception that the first one of them continues as a continuous metal strip 443 across the upper surface of the dielectric support plate 411, while the other one crosses the continuous metal strip in question by means of the bridge section 415.

A mounting hole 405 can be seen in the middle of the bottom part of the feed tower 402, by means of which the feed tower can easily be attached to a desired base. The screws in FIGS. 4 and 5 are only one example for attaching the dielectric support plate 411 and the input tower 402 with each other. Instead or in addition to these, it would be possible to use, for example, rivets, pop rivets, clenched pins, glue, nails, or other mechanical fastening means known by those skilled in the art. No feed conductor passes through the branches 422 and 432 of the feed tower, so these would not need to be hollow. By making them hollow in any case, as in the embodiment shown in FIGS. 4 and 5, it is possible to save manufacturing material. In addition it may be simple for the manufacturing technology that the input tower only contains one (hollow) type of branches.

Figure 6A:
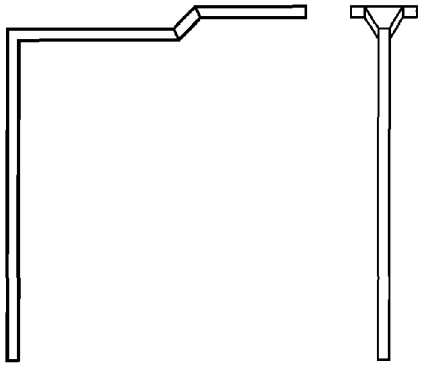
FIGS. 6*a* and 6*b* illustrate some alternative shapes for a feed conductor.
Figure 6B:
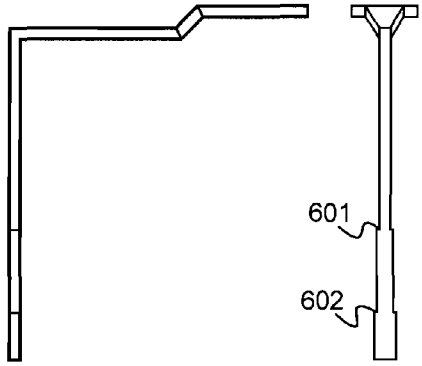

It is possible to influence the feed impedance of the antenna structure by the design of the feed conductor. FIGS. 6*a* and 6*b* illustrate two exemplary feed conductors, of which the feed conductor in FIG. 6*a* generates a feed impedance of 75 ohm, and the feed conductor in FIG. 6*b* a feed impedance of 50 ohm. The only difference between these two feed conductors is that the lower end of the feed conductor in FIG. 6*b* is provided with two stepped extensions 601 and 602. In these Figures, the feed conductors are illustrated having a quadrate or rectangular cross section, but their cross section could also be, for example, circular, oval, or triangular.

Figure 7A:
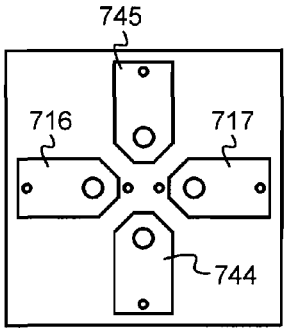
FIGS. 7*a*-7*c* illustrate some alternatives for metallising the lower surface of the dielectric support plate.
Figure 7B:
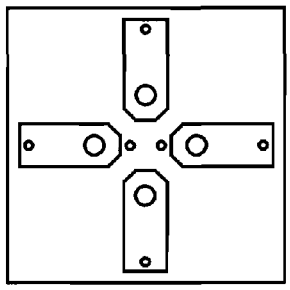
Figure 7C:
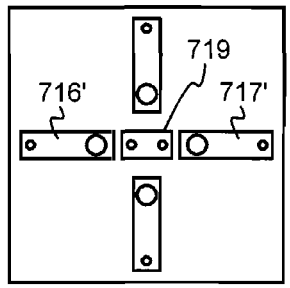

FIGS. 7*a*, 7*b* and 7*c* illustrate three examples of the metal coatings for the lower surface of a dielectric support plate. The difference between the FIGS. 7*a* and 7*b* lies mainly in the different width of the metal strips. In FIG. 7*a*, the metal strips 716 and 717 belong to the first antenna radiator in the form of a folded dipole and they are, thus, equivalent to the metal strips 416 and 417 in FIG. 5. The metal strips 744 and 745 belong to the second antenna radiator in the form of a folded dipole. Two small holes in the middle of the plate, between the metal strips 716 and 717, are fastening holes for the bridge section to be placed on the upper surface of the dielectric support plate. The hole at the outer end of each metal strip 716, 717, 744 and 745 is a metallised via, connecting the outer end of the metal strip in question to the outer end of the metal strip on the upper surface of the dielectric support plate.

It is possible to prepare two crossed folded dipoles that do not touch each other also without a bridge section by bringing the second folded dipole at the intersection onto the lower surface of the dielectric support plate by means of the metallised vias. FIG. 7*c* illustrates an alternative for metallising the lower surface of the dielectric support plate in such a case. The short metal strip 719 in the middle of the plate belongs to the same folded dipole as the metal strips 716' and 717'. It is connected with the inner end of the two metal strips on the upper surface of the dielectric support plate through the metallised vias, and thus it connects them in a similar way as the bridge section 415 in FIGS. 4 and 5, but only on one side of the dielectric support plate.

Figure 8A:
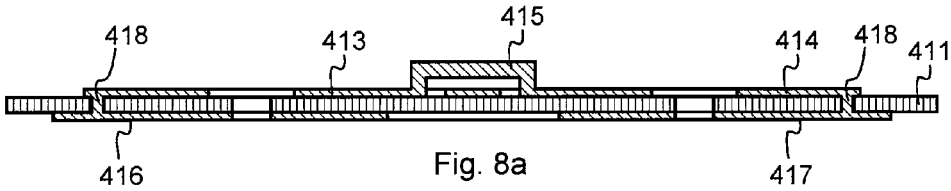
FIGS. 8*a* and 8*b* illustrate some alternatives for metallising the dielectric support plate.
Figure 8B:
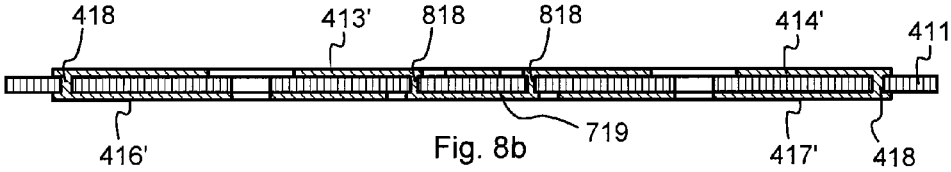

FIGS. 8*a* and 8*b* are cross-sections, which show the dielectric support plate 411 and which illustrate two exemplary ways to dimension the metal strips on the upper and lower surfaces. FIG. 8*a* is directly equivalent to the dimensioning shown in FIG. 5: at their outer ends, the metal strips 416 and 417 on the lower surface of the dielectric support plate 411 extend longer than the respective metal strips 413 and 414 on the upper surface of the dielectric support plate. In FIG. 8*b*, the strips extend equally far both on the upper and the lower surface. FIG. 8*b* also illustrates a similar folded dipole without a bridge section, which was referred to in connection with FIG. 7*c*. The folded dipole consists of the metal strips 413', 414', 416', 417' and 719, and of metallised vias 418 and 818.

Figure 9A:
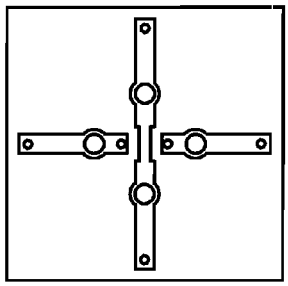
FIGS. 9*a*-9*d* illustrate some alternatives for metallising the upper surface of the dielectric support plate.
Figure 9B:
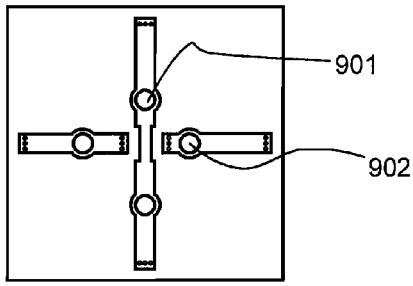
Figure 9C:
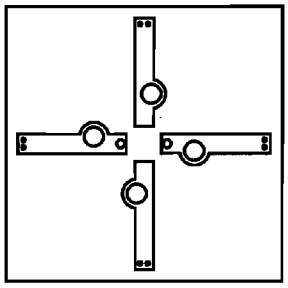

FIGS. 9*a*, 9*b*, 9*c* and 9*d* show different alternatives for placing the metallised vias and fastening holes in a dielectric support plate. In FIG. 9*a*, each point requiring a conductive lead-through has a single metallised via. The fastening holes are located symmetrically so that for the fastening holes, the solution is similar to the one in FIG. 4. In FIG. 9*b*, at each point requiring a conductive lead-through there are three parallel metallised vias. Upon placing the fastening holes, the knowledge has been used that no feed conductors travel in side the two branches of the feed tower, in which case—if these branches are nevertheless hollow—the hollow upper end of the branch itself may be used as the fastening hole. For this reason, the holes 901 and 902 in FIG. 9*b* are closer to the centre of the dielectric support plate than the two other fastening holes. In FIG. 9*c*, the number of the metallised vias is different in different places, and the fastening holes are not located on the middle line of the metal strips on the upper surface of the dielectric support plate. This naturally requires that also the fastening holes in the feed tower (not shown) are located in the same non-central way.

Figure 9D:
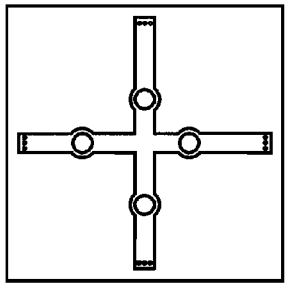

Experiments have shown that it is not actually necessary to electrically isolate the two crossing folded dipole radiators at the point where they meet on the upper side of the dielectric plate. FIG. 9*d* illustrates a simple solution in which the metallised strips that constitute the upper parts of the folded dipoles simply cross. Thus there is no need for separate bridges, and none of the strips needs to be taken temporarily onto the lower side of the dielectric plate at the crossing point. All that has been said about varying the location of holes and other structural factors can naturally be combined with the principle of allowing the folded dipoles cross as in FIG. 9*d*.

Figure 10A:
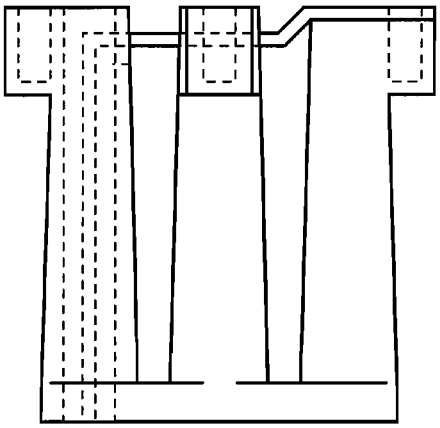
FIGS. 10*a* and 10*b* illustrate some alternative shapes for a feed tower.
Figure 10B:
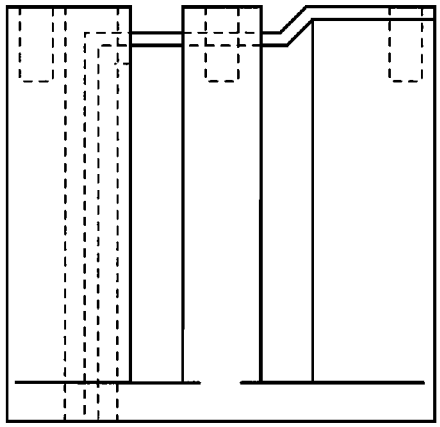

FIGS. 10*a* and 10*b* illustrate some alternative embodiments of the feed tower structure. In the feed tower of FIG. 10*a*, only the branches with the feed conductor travelling inside are hollow. In the embodiment of FIG. 10*b*, the fastening holes are not located in the projections at the upper end of the branches of the feed tower, but the branches of the feed tower are throughout their length so thick that both the longitudinal cavities and fastening holes required by the feed conductors can be inserted in them.

Figure 11A:
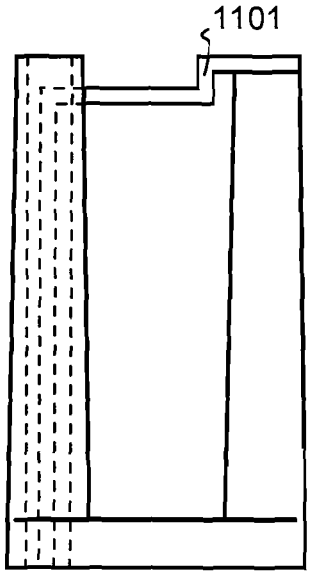
FIGS. 11*a*-11*e* illustrate some alternatives for the side profiles of a feed tower.
Figure 11B:
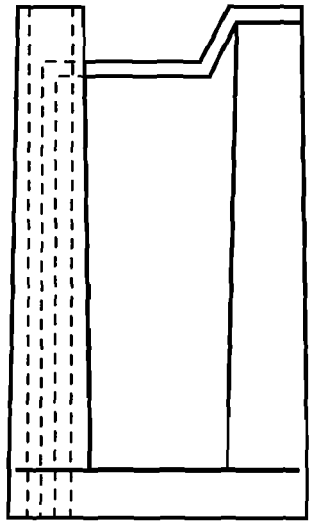
Figure 11C:
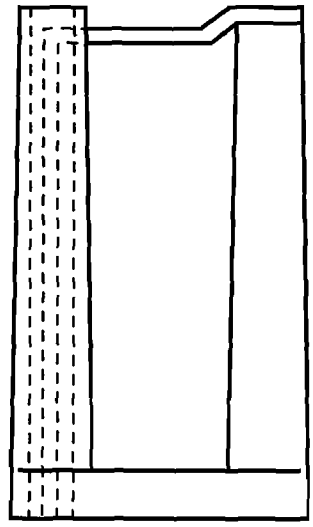
Figure 11D:
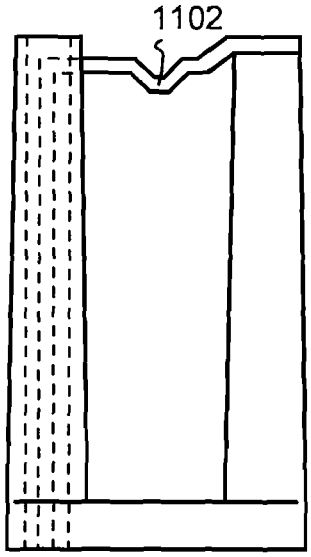
Figure 11E:
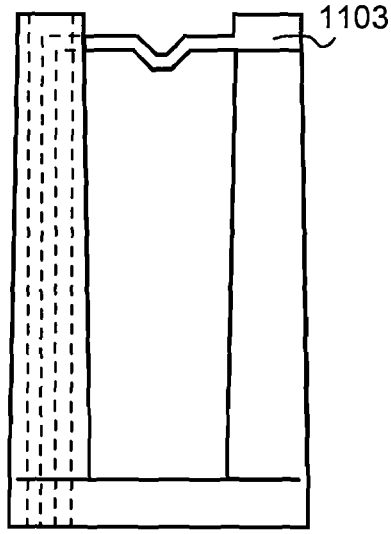

FIGS. 11*a*, 11*b*, 11*c*, 11*d* and 11*e* illustrate some exemplary side profiles for the feed conductors. Deviating from the bevelled sections explained above, the feed conductor in FIG. 11*a* has a stepped bend 1101. FIGS. 11*b* and 11*c* show that it is not essential for the invention how far from the upper end of the feed tower the horizontal section of the feed conductor is located. This, as also other contributory factors for the dimensioning of the feed conductor influence the feed impedance of the antenna structure so that it is possible to find the best dimensioning values for different situations by experimenting and/or simulating. The feed conductors according to FIGS. 11*b* and 11 *c*, with the horizontal section at different heights, can be used in the same structure as crossed feed conductors so that it is not necessary to make a bend to the horizontal section of either feed conductor. In FIG. 11 *d*, the horizontal section of the feed conductor has only a small, local bend 1102. The horizontal section of the other feed conductor (not shown) can then be straight or it can be provided with a corresponding bend upwards. FIG. 11*e* illustrates an embodiment, in which the upper end 1103 of the feed conductor is so thick in the elevated direction that the horizontal section of the feed conductor can be completely horizontal (with the exception of the bends that are needed to dodge a possible second feed conductor).

Figure 12A:
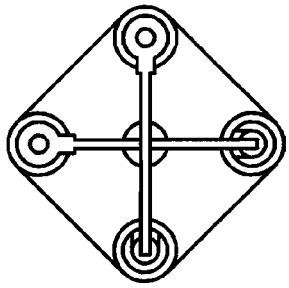
FIGS. 12*a*-12*d* illustrate some alternative shapes for the upper part of feed conductors.
Figure 12B:
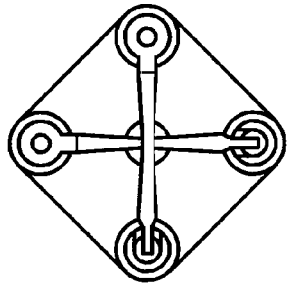

FIGS. 12*a*, 12*b*, 12*c* and 12*d* illustrate some exemplary ways, with which the width of the feed conductor can vary, for example, in its horizontal section (as has been stated above in connection with FIG. 6*b*, the cross-section of the feed conductor can vary also in its vertical section). At the same time the Figures show how fastening holes are not necessarily needed in every branch of the feed tower: in the embodiments illustrated in these Figures, longitudinal cavities with no feed conductor and passing through the branches are used as fastening holes. In FIG. 12*b*, the horizontal section of the feed conductors is throughout of the same width as their vertical section, and the feed conductor widens only when forming the planar section of the size of the upper end of the branch of the input tower, the purpose of which is to press against the metal strip on the lower surface of the dielectric support plate (not shown in the Figure), and thus form a feed point. In FIG. 12*b*, the horizontal section of the feed conductor is generally wider than its vertical section, but the horizontal section narrows evenly from its ends towards the midpoint, which is located at the intersection of the feed conductors.

Figure 12C:
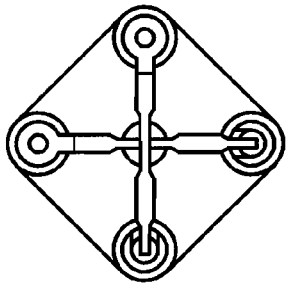
Figure 12D:
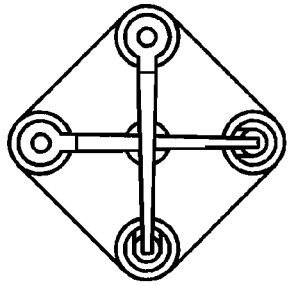

The embodiment in FIG. 12*c* differs from FIG. 12*b* so that the horizontal section of the feed conductor does not narrow evenly towards its midpoint, but the midpoint of the horizontal section of the feed conductor has a point, which is narrower than the rest of the horizontal section. In FIG. 12*d*, the horizontal section of the feed conductor is the widest at the point, in which it joins the planar section of the size of the branch of the feed tower and narrows evenly towards the point, in which the horizontal sections turns into the vertical section.

Figure 13A:
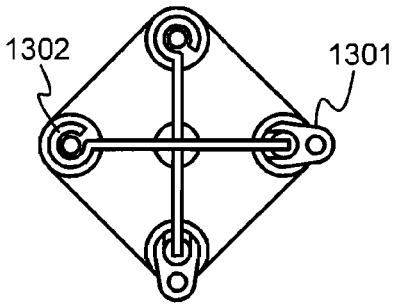
FIGS. 13*a*-13*c* illustrate some alternatives for placing the fastening points.
Figure 13B:
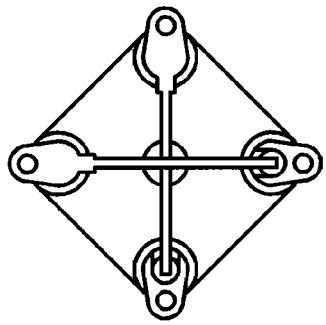
Figure 13C:
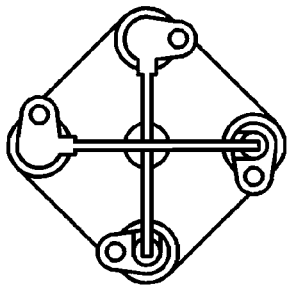

FIGS. 13*a*, 13*b* and 13*c* illustrate some ways for placing the fastening holes. In FIG. 13*a*, cavities travelling inside two branches of the feed tower are used as fastening holes. The branches, in which a feed conductor passes through the hollow inner part, have a separate projection 1301 for the fastening hole. In addition, FIG. 13*a* shows an exemplary way for forming the upper end of the feed conductor: instead of the planer section described earlier, the upper end of the feed conductors in FIG. 13*a* have a hook 1301 bent from the flat material of the feed conductor, the empty section remaining in its middle corresponding to the hole at the upper planar ends of the feed conductor. The embodiment in FIG. 13*b* corresponds to the embodiment shown in FIGS. 4 and 5, i.e. each branch of the feed tower is provided with a projection for the fastening hole (or each branch is all the way down thicker by the location point of the fastening hole as in FIG. 10*b*). In FIG. 13*c*, each branch of the feed tower has a projection for the fastening hole, but the projection is not located on the outer surface of the branch, but at the side. The respective holes of the dielectric support plate (not shown in the Figure) would then most naturally be located in the way shown above in FIG. 9*c*).

Figure 14:
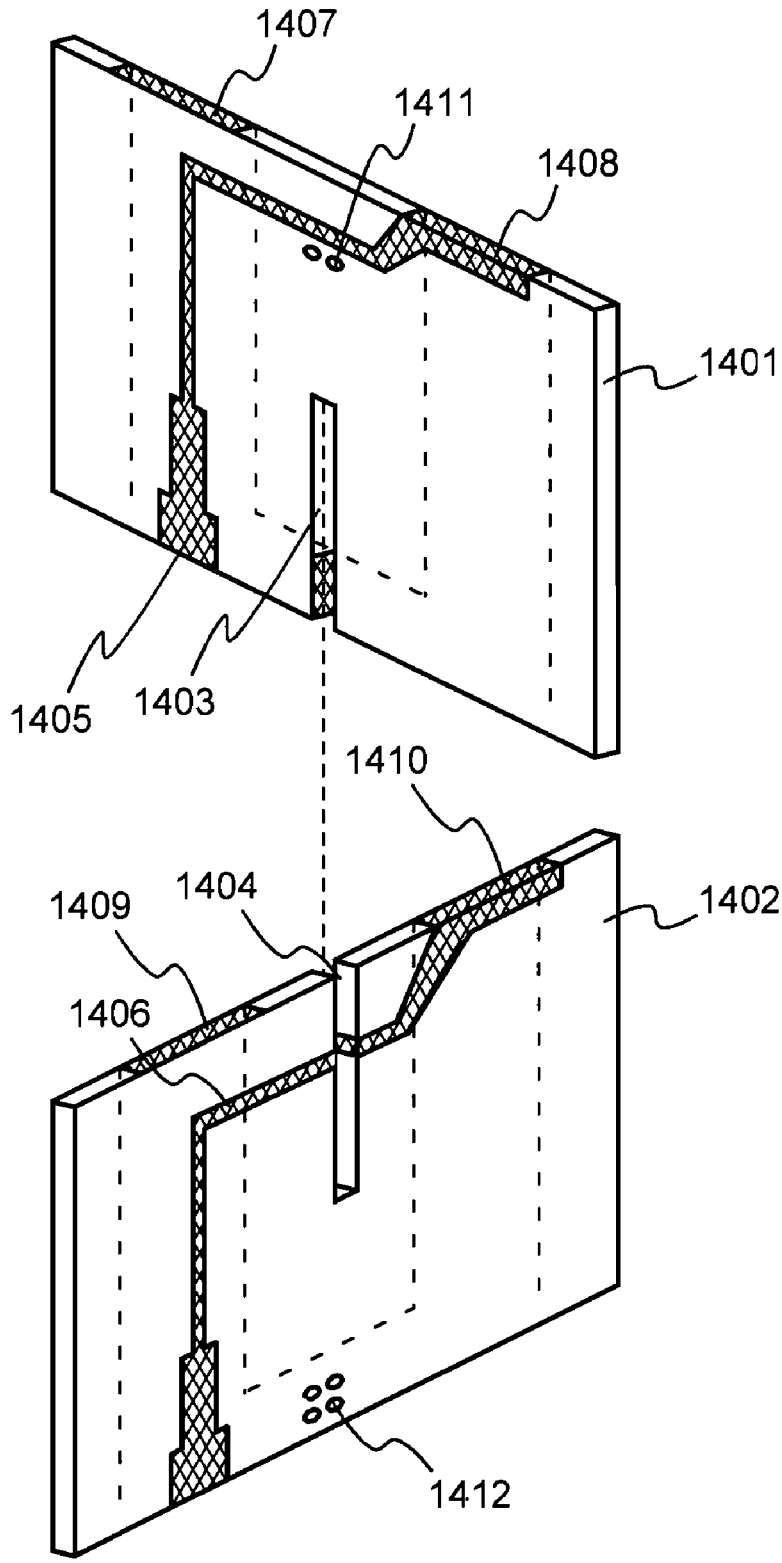
FIG. 14 illustrates an alternative feed tower.

FIG. 14 illustrates an alternative way for forming the feed tower. In this, the feed tower consists of the first dielectric plate 1401 and the second dielectric plate 1402, which are placed crosswise. For this purpose, the first dielectric plate has a link 1403 in the middle of the lower edge of the dielectric plate, and the second dielectric plate has a link 1404 in the middle of the upper edge of the dielectric plate. The depth of each link is half of the height of the dielectric plate. The first side surface of each dielectric plate 1401 and 1402 is provided with a U-form metallised area, the electric operation of which is equivalent to the frame of the feed tower in FIG. 2. The second side surface of each dielectric plate 1401 and 1402 has the feed conductor 1405 and 1406, respectively. No antenna plate is shown in FIG. 14, which would nevertheless clearly reflect what is shown in FIGS. 2 (cf. antenna plate 201), and 4 and 5.

In FIG. 14, the feed points to the ends of the radiating antenna element on the lower surface of the described antenna plate consist of metallised regions 1407, 1408, 1409 and 1410 in the upper edge of the dielectric plates 1401 and 1402. Each of these metallised regions is located in the upper end of an arm of the U-form metallised region. The upper ends of the feed conductors 1405 and 1406 connect to the same metallised region 1408 and 1410, which is not in the upper end of the same arm as where the vertical section of the feed conductor is located. The links 1403 and 1404 in the dielectric plates 1401 and 1402 require the use of metallised vias 1411 and 1412 in the section of the dielectric plate that extends to the link so that the connection conducting electricity would not break by the link. FIG. 14 does not take a stand on how the fastening screws or other fastening means for fastening the antenna plate are placed in the feed tower, because one skilled in the art can easily present suitable solutions for this.

The structure illustrated in FIG. 14 is well suitable to be simplified to an antenna with one polarisation. In this case, one dielectric plate will be enough, and no links or metallised vias required by the links will be needed. Because the uniformity of the feed conductor is much more important for the operation of the antenna than the uniformity of the lower part of the U-form metallised section, a variation can be presented from the embodiment in FIG. 14, in which the link 1403 is very deep and the link 1404 very shallow, respectively, so that the feed conductor 1406 can continue in a uniform manner from one end to the other.

In FIG. 14, the vertical section of the feed conductor and the metallised region on the one side of the dielectric plate at this point correspond electrically to the transmission line, which in FIGS. 2, 4 and 5 consists of the vertical section of the feed conductor and the electrically conductive surrounding wall of the cavity passing through the branch of the feed conductor in the vertical direction. The width of the feed conductor may vary in a desired way; the two stepped variations in the lower end of the feed conductor are shown as an example for changing the impedance.

The antenna structure according to the invention is suitable to be used, for example, in base stations for cellular radio systems. For example, if the desired frequency range is of the size of approximately two gigahertz, the wave length quarter essential for the height of the feed tower is approximately 30 mm. However, the antenna structure according to the invention can be used in antennas of radar devices, in satellite positioning devices, and in other small radio equipment in general.

The invention may be varied from what has been presented above. For example, it is in no way essential for the invention that the branches of the feed conductor are exactly perpendicular to the antenna plate, although this solution has its own advantages, for example, in the form of easier modelling and manufacture. The crossed radiating antenna elements need not be identical, and it is not necessary to use them for transmitting and/or receiving the same signal with different polarisations, but the antenna elements can be dimensioned in a different way so that the antenna structure has two independent antennas of one polarisation.

The invention claimed is:

1. An antenna for a radio device, comprising a feed tower and a first radiator, at a first end of the feed tower wherein the first radiator is a folded dipole made from metal strips connected with each other on at least two surfaces of a dielectric support plate, which plate is mechanically attached to the first end of the feed tower;

the feed tower comprises a conductive first branch connected to a first point in the first radiator and a conductive second branch connected to a second point in the first radiator, which branches are in a conductive connection with each other at a second end of the feed tower;

the feed tower further comprises a first feed conductor, a first portion of which forms a transmission line with said first branch and a second portion of which extends from said transmission line to the second branch at the first end of the feed tower, in said second point;

inside the first branch there is a cavity extending from the first end of the feed tower to the second end;

said transmission line comprises an electrically conductive wall of said cavity and of a portion of the first feed conductor, which travels in said cavity;

there is a hole in the wall of the cavity at the first end of the feed tower on the side of the first branch facing towards the second branch; and the first feed conductor travels through the hole.

2. An antenna according to claim 1, wherein the cross-section of the first feed conductor changes in a certain point of its portion, which is inside said cavity.

3. An antenna according to claim 1, wherein the cross-section of the first feed conductor changes in a certain point of its portion, which extends from said transmission line to the second branch.

4. An antenna according to claim 1, wherein there is a fastening hole at the first end of the feed tower in at least one branch for mechanical fastening of the dielectric support plate to the feed tower.

5. An antenna according to claim 1, wherein the antenna further comprises a second radiator being a folded dipole and comprised of metal strips, which are connected with each other on at least two surfaces of the dielectric support plate; and at said first end, the feed tower is electrically connected to two different points in the second antenna element.

6. An antenna according to claim 5, the feed tower comprising an electrically conductive third branch and fourth branch, which are in an electrically conductive connection with each other at the second end of the feed tower, and a second feed conductor, a first portion of which forms a transmission line with the third branch, and a second portion of which extends from said transmission line to the fourth branch at the first end of the feed tower.

7. An antenna according to claim 6, wherein inside the third branch there is a cavity extending from the first end of the feed tower to the second end;

said transmission line consists of an electrically conductive wall of said cavity and of a portion of the second feed conductor, which travels in the cavity;

there is a hole in the wall of the cavity at the first end of the feed tower on the side of the third branch facing towards the fourth branch; and the second feed conductor travels through the hole.

8. An antenna according to claim 7, wherein the second end of the feed tower is formed by a quadrangular bottom plate, said first, second, third, and fourth branch of the feed tower being located in its corners.

9. An antenna according to claim 5, wherein the metal strips belonging to the first antenna element and the second antenna element have a crossing point on the surface of the dielectric support plate.

10. An antenna according to claim 9, the metal strips of different antenna elements being prevented from contacting each other in said crossing point by using a bridge section or a metal strip on the opposite side of the dielectric support plate connected to other metal strips by means of metallised vias.

11. An antenna according to claim 1, being arranged to be connected from the second end of the feed tower to an antenna port of the radio device by an unbalanced transmission line.

12. An antenna according to claim 11, wherein its feed impedance at the second end of the feed tower is 35 to 120 ohm.

13. A method for manufacturing an antenna structure, comprising steps:

constituting a first radiator comprising a folded dipole from metal strips connected to each other on at least two surfaces of a dielectric support plate; and fastening the dielectric support plate mechanically to a first end of a feed tower so that the feed tower is electrically connected to two different points in the first radiator at said first end;

installing a feed conductor to travel along a cavity inside a first branch of the feed tower to a hole at an upper end of the first branch and through the hole to an upper end of a second branch of the feed tower; and pressing an end of said feed conductor between the upper end of the second branch of the feed tower and the dielectric support plate so that said end of the feed conductor contacts a metal strip belonging to the first radiator on the surface of the dielectric support plate.

* * * * *